US008988008B2

(12) United States Patent
Seward, IV

(10) Patent No.: US 8,988,008 B2
(45) Date of Patent: Mar. 24, 2015

(54) LIGHT CONTROL CIRCUIT AND METHOD

(71) Applicant: Silicon Laboratories Inc., Austin, TX (US)

(72) Inventor: DeWitt C. Seward, IV, Arlington, MA (US)

(73) Assignee: Silicon Laboratories Inc., Austin, TX (US)

( * ) Notice: Subject to any disclaimer, the term of this patent is extended or adjusted under 35 U.S.C. 154(b) by 174 days.

(21) Appl. No.: 13/723,921

(22) Filed: Dec. 21, 2012

(65) Prior Publication Data

US 2014/0176004 A1 Jun. 26, 2014

(51) Int. Cl.
*H05B 37/02* (2006.01)

(52) U.S. Cl.
CPC ..... *H05B 37/0272* (2013.01)
USPC ..... 315/307; 315/294; 315/287; 315/360; 315/194

(58) Field of Classification Search
CPC ..... H05B 37/02; H05B 39/04; H05B 39/048; H05B 37/0281; H05B 41/2928; Y02B 20/148; Y02B 20/208; H03K 17/13; H03K 17/136; H02M 5/2573; H02M 5/2576; H02M 5/275
USPC ..... 315/194, 291, 294, 307, 311, 360, 287, 315/308; 327/451, 452, 455, 459, 476; 323/237, 241, 319–323
See application file for complete search history.

(56) References Cited

U.S. PATENT DOCUMENTS

| | | | | |
|---|---|---|---|---|
| 4,258,276 | A * | 3/1981 | Beling | 327/459 |
| 5,680,015 | A * | 10/1997 | Bernitz et al. | 315/291 |
| 6,262,565 | B1 * | 7/2001 | Williams et al. | 323/237 |
| 6,969,959 | B2 * | 11/2005 | Black et al. | 315/307 |
| 8,664,881 | B2 * | 3/2014 | Newman et al. | 315/291 |

OTHER PUBLICATIONS

Silicon Laboratories, Inc., EM35x Data Sheet, "EM351/EM357, High-Performance, Integrated ZigBee/802.15.4 System-on-Chip", 244 pages, last updated Dec. 7, 2012, www.silabs.com/Support%20Documents/TechnicalDocs/EM35x.pdf, submitted in 3 parts.

* cited by examiner

*Primary Examiner* — Haiss Philogene
(74) *Attorney, Agent, or Firm* — Nields, Lemack & Frame, LLC

(57) ABSTRACT

A system and method for controlling the dimming of a lighting element, or other electrical load, that uses a timer synchronized to the AC waveform is disclosed. The timer is set up to repeatedly count at a rate equal to twice the frequency of the AC waveform. An output from the timer logic is asserted when the timer value exceeds a predetermined value, stored in a compare register. This output is connected to the gate of a triac, which controls the passage of current from the AC power source to the electrical load. A capture register is used to determine the temporal relationship between the restart of the timer and the AC waveform. This system and method reduces the real time requirements of an associated processing unit, and improves consistency, thereby reducing flicker.

11 Claims, 7 Drawing Sheets

LIGHT CONTROL CIRCUIT AND METHOD

BACKGROUND

Today, with the advent of wireless technology, many aspects of everyday life can be controlled remotely. These include remote security systems, lighting systems, utility meter reading and many other applications.

Remote lighting systems have evolved and are able to not only remotely control turning on and off lighting, but also to control the intensity of the lighting.

FIG. 1A shows a conventional circuit used to control the brightness of a lighting system. A triac 10 is disposed in series between an AC power source 20 and the lighting 30. The gate of the triac 10 controls the passage of current between the AC power source 20 and the lighting 30. A positive or negative voltage (relative to the A1 terminal) applied to the gate triggers the triac 10 to conduct current between the A1 and A2 terminals. Once the triac begin conducting current, it will continue until the current between the A1 and A2 terminal drops below a certain threshold. Thus, once the gate voltage is applied, the triac 10 will conduct current until the next zero crossing, which is defined as the point at which the AC voltage crosses from positive to negative or negative to positive. Thus, by controlling the gate signal, the lighting system can be controlled. In its simplest form, the gate can be held at a low voltage to turn the lighting off, and held at a higher voltage to turn the lighting on.

FIG. 1B shows the gate voltage waveform that can be used to dim the lighting. In this example, the input to the A1 terminal ($V_{in}$) is a voltage in the form of a sine wave, as is typical of AC power sources. The A2 terminal is in electrical communication with the lighting 30. In this figure, the gate voltage is pulsed about 20% of a half-period after the zero crossing of the $V_{in}$ input signal. At this point, current begins to flow through the triac 10, as shown in the $V_{out}$ graph. Current continues to flow until the next zero crossing of the $V_{in}$ signal. Thus, by varying the position of the gate pulse relative to the zero crossing, the amount of power delivered to the lighting 30 can be controlled.

While the above description utilizes a lighting system, it is noted that it is equally applicable to an AC power load that can accept a variable input, including electric motors.

While the circuit of FIG. 1A is power efficient and effective in controlling power delivered to a lighting system, it has some drawbacks. For example, variability in the assertion of the gate pulse relative to the $V_m$, can cause annoying flicker, which is perceivable to the human eyes. Therefore, an improved circuit for controlling the current supplied to a lighting system, or other electrical load, would be beneficial.

SUMMARY

A system and method for controlling the dimming of a lighting element, or other electrical load, that uses a timer synchronized to the AC waveform is disclosed. The timer is set up to repeatedly count at a rate equal to twice the frequency of the AC waveform. An output from the timer logic is asserted when the timer value exceeds a predetermined value, stored in a compare register. This output is connected to the gate of a triac, which controls the passage of current from the AC power source to the electrical load. A capture register is used to determine the temporal relationship between the restart of the timer and the AC waveform. This system and method reduces the real time requirements of an associated processing unit, and improves consistency, thereby reducing flicker.

DETAILED DESCRIPTION OF THE INVENTION

Figure 2:
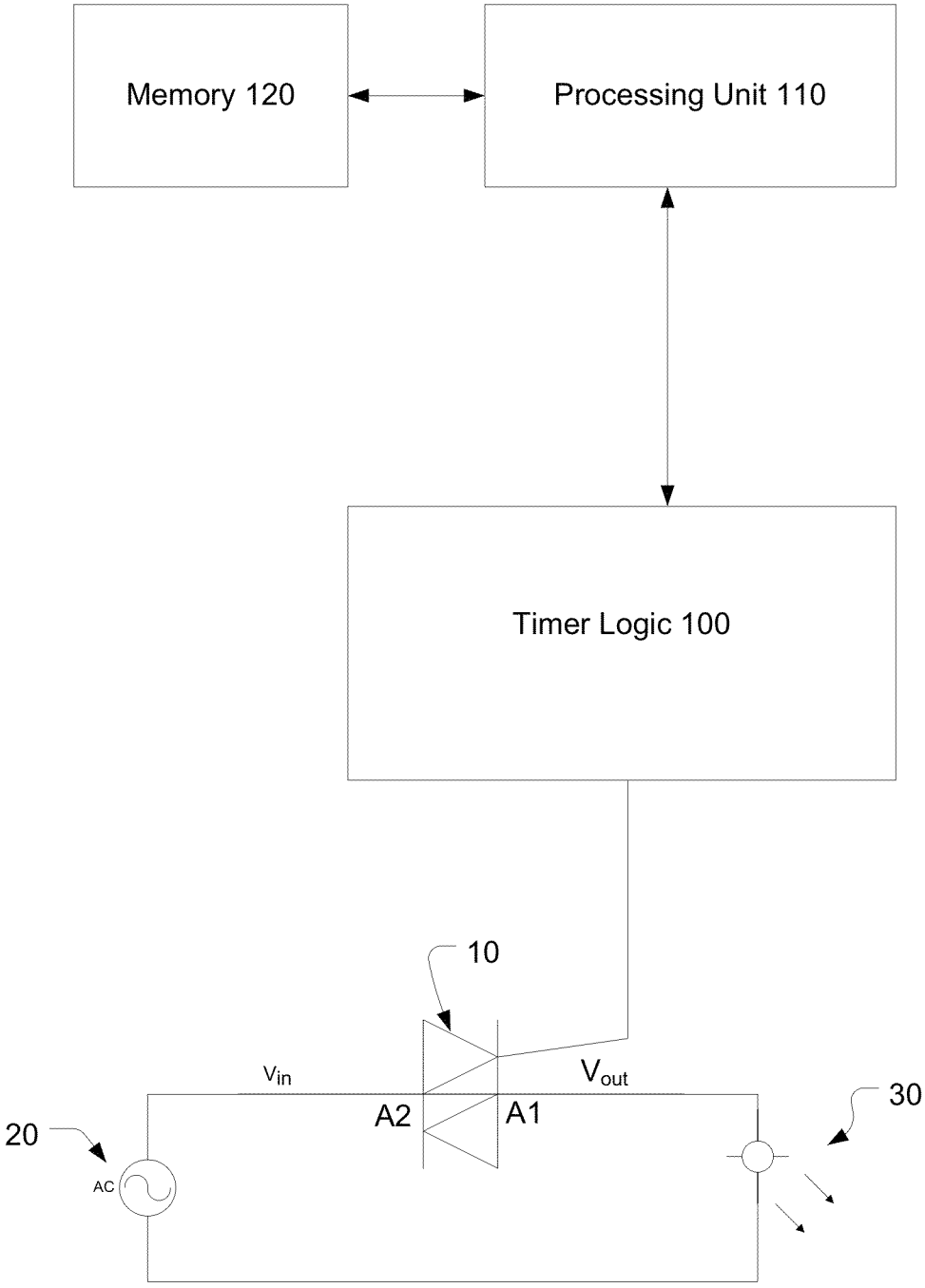
FIG. 2 is a representative system used for controlling dimming of a lighting element according to one embodiment.

FIG. 2 shows a block diagram of a representative system that may be used to control the current being supplied to a lighting system. As described above, this system may be used for any AC load where variable input is acceptable.

AC source 20, triac 10 and lighting element 30 are as described above and their description will not be repeated here. The system includes a processing unit 110 in electrical communication with a memory element 120.

The processing unit 110 may be any suitable device, such as, but not limited to, an embedded microcontroller, a general-purpose microprocessor, a custom or semicustom microcontroller. The processing unit 110 may be dedicated to this function, or may also be responsible for performing other functions as well. The processing unit 110 performs the functions described herein by executing computer readable instructions, stored in a memory element 120. Although the memory element 120 is shown separately, it is noted that the memory element 120 may be integrated with the processing unit 110. Indeed, the memory element 120, the processing unit 110 and the timer logic 100 may all be integrated into one integrated circuit if desired.

The memory element 120 may use any suitable technology, such as semiconductor, magnetic, or optical. In addition, if semiconductor memory is used, different types may be employed, including but not limited to FLASH, EEPROM, DRAM, and static RAM. In some embodiments, the memory element 120 has a non-volatile portion, which retains its contents, during periods without power, and a volatile portion. The non-volatile portion may be used to contain the instructions to be executed by the processing unit 110. The instructions may be written in any suitable language so as to be computer readable by the processing unit 110. In addition, these instructions allow the processing unit to perform all of the functions and methods described herein.

The processing unit 110 is also in electrical communication with timer logic 100. The timer logic 100 receives commands and data from the processing unit 110, and uses this information in conjunction with its internal logic, to generate the gate signal for the triac 10.

Figure 3:
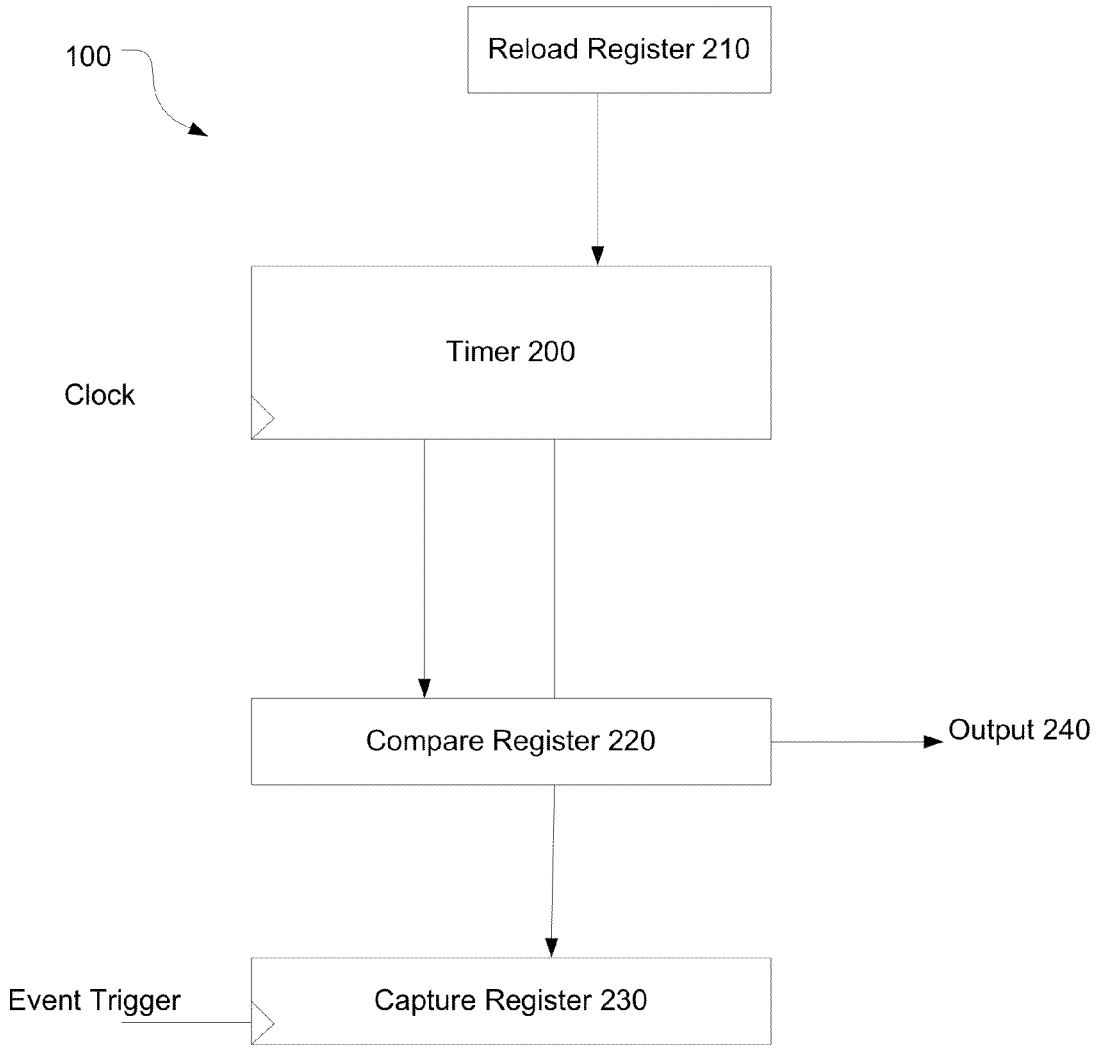
FIG. 3 is a representative schematic of the timer logic of FIG. 2.

FIG. 3 is a representative block diagram of the timer logic 100. The timer logic 100 comprises a timer 200. This timer 200 is clocked by a clock input, which may be any suitable frequency. In some embodiments, there may be multiple sources that can be used as the input to the timer 200. In some embodiments, the timer 200 may be programmable, such that it can be programmed to count upward, or count downward. In other embodiments, the timer 200 is only capable of counting in one direction. The timer logic 100 also contains a reload register 210. This reload register 210 works in conjunction with the timer 200. In the scenario where the timer 200 is programmed to count upward, the timer 200 may count until it reaches the value of the reload register 210. At this point, the timer 200 resets to zero, and begins counting upward again. In the scenario where it counts down, when the timer reaches zero, it loads the value of the reload register 210, and begins counting down again. In either case, the combination of the timer 200 and the reload register 210 allow the timer 200 to operate in a periodic fashion, where the period is defined by the frequency of the clock input and the value of the reload register 210.

Output 240 is generated by using the timer 200 in conjunction with the compare register 220. In one embodiment, when the value of the timer 200 reaches or exceeds the value of the compare register 220, the output 240 is asserted. This output 240 remains asserted as long as the value of the timer 200 exceeds the value of the compare register 220.

To illustrate the operation of the timer 200, reload register 210 and compare register 220, assume that the reload register 210 has a value of 1300 and the compare register 220 contains a value of 1250. The timer 200 starts counting at zero. When it reaches the value of 1250, which matches the value of the compare register 220, the output 240 is asserted. This output 240 remains asserted as the timer 200 continues counting upward. When the timer 200 reaches 1300 (the value of the reload register 210), the timer 200 resets to zero. This reset also causes the deassertion of output 240, as the value of the timer 200 is now less than the compare register 220. Thus, the output 240 has a period of 1300 clock cycles, and has a pulse width of 50 (i.e. 1300 minus 1250) clock cycles.

Returning to FIG. 1B, it is shown that the Gate signal is also a periodic signal, having a predetermined pulse width. Therefore, it is possible to use the timer logic 100 shown in FIG. 3 to generate the desired gate pulse.

To achieve the desired gate pulse, the reload register 210 is loaded with a value such that the period of the timer 200 matches the half period of the AC wave. Knowing that an AC voltage has a frequency of 60 Hz, it is well known that the half period of the AC wave is 1/120 Hz, or 8.3333 milliseconds. Based on this, the reload value is determined as:

$$\text{Reload Value} = 8.33333\ \text{ms} \times \text{timer clock frequency (in KHz)}$$

For a timer clock frequency of 3 MHz, the reload value would be 25,000. Of course, if the AC frequency is known to be different than 60 Hz, the equation above can be correspondingly modified. Similarly, if the timer clock frequency is different than the example above, a different reload value may result.

Figure 1A:
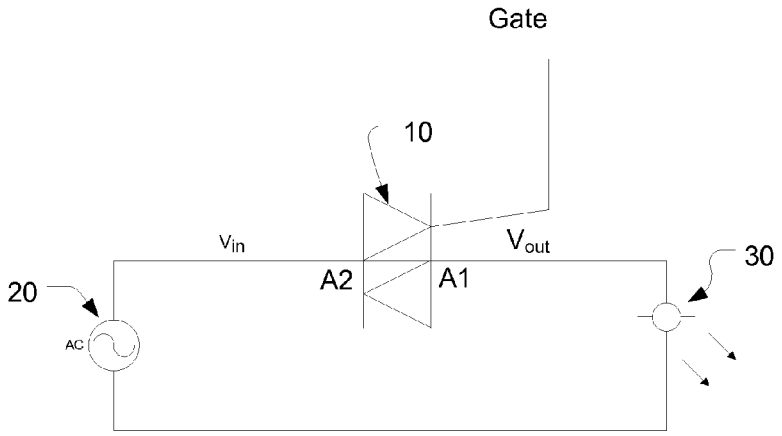
FIGURE 1A (PRIOR ART)
FIG. 1A is a representative dimmer circuit of the prior art.
Figure 1B:
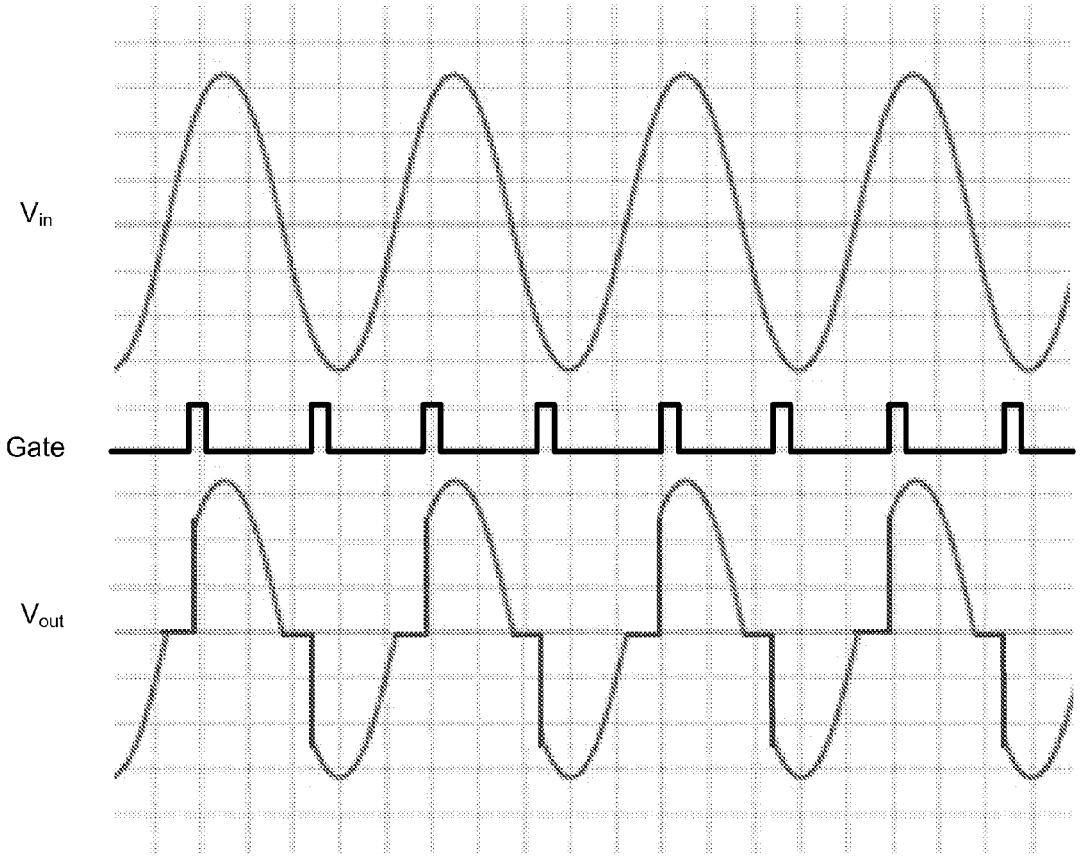
FIGURE 1B (PRIOR ART)
FIG. 1B is a set of waveforms showing the operation of the circuit of FIG. 1A.

Having determined the proper reload value so that the timer 200 remains locked to the AC wave, the pulse width of the output 240 is then generated. As shown in FIG. 1B, the pulse width of the gate signal does not need to be large. In fact, it is preferable to maintain a shorter pulse width for several reasons. Specifically, the gate pulse is used to turn on the triac for a particular half period. However, if the gate pulse were to remain asserted past the next zero crossing, the triac would be incorrectly turned on for the entirety of that subsequent half period. Therefore, it is important to insure that the gate pulse is deasserted as the AC wave approaches the next zero crossing. Thus, a short pulse width is preferable. To achieve the desired pulse width, the compare register is set to a value less than the reload value that creates the desired pulse width. Specifically, the pulse width is defined as:

$$\text{Pulse width} = (\text{Reload value} - \text{Compare value})/\text{Timer Clock frequency}$$

If a pulse width of 50 microseconds if desired, the compare register would be loaded with a value of 24850 (a difference of 150 counts at 3 MHz defines the 50 microsecond pulse). Any pulse widths can be generated by varying the value of the compare register.

Having defined the mechanisms used to create a period pulse of a predetermined width, the system and method for generating that pulse at the appropriate time will be defined.

Returning again to FIG. 1B, it can be seen that the gate pulse was generated about 20% of a half period after the zero crossing. Since the output 240 is asserted right before the timer 200 reaches its reload value, the timer 200 must be synchronized to the AC waveform such that its maximum value occurs about 20% of a half period after the zero crossing. Synchronization of the timer 200 to the AC wave requires use of the capture register 230, shown in FIG. 3.

The capture register 230 is able to load the value of the timer 200 at a specific instance in time. For example, the capture register 230 may have an event trigger, so that when the event trigger occurs, the current value of the timer 200 is stored in the capture register 230. In one embodiment, the event trigger is defined to be the zero crossing of the AC waveform. Thus, when the AC waveform has a zero crossing, the value of the timer 200 is captured. This value allows the processing unit 110 to determine where the pulse will occur. The value of the capture register 230 can be multiplied by the period of the timer clock input to determine the elapsed time since the last reload of the timer 200. This value can then be subtracted from the half period of the AC waveform to determine how long after the zero crossing the pulse will occur. Thus, by reading the capture register, the relationship between the timer 200 and the phase of the AC wave can be determined.

For example, assume a 3 MHz timer clock frequency and a 60 Hz AC waveform, as demonstrated above. If the pulse is to occur 20% of a half period after the zero crossing, then the value of the timer 200 should be at 80% of its maximum value when the zero crossing occurs. Generally, if a pulse is to occur x % of a half period after the zero crossing, the value of the timer 200 at the zero crossing should be (100-x) % of its maximum value.

Figure 4A:
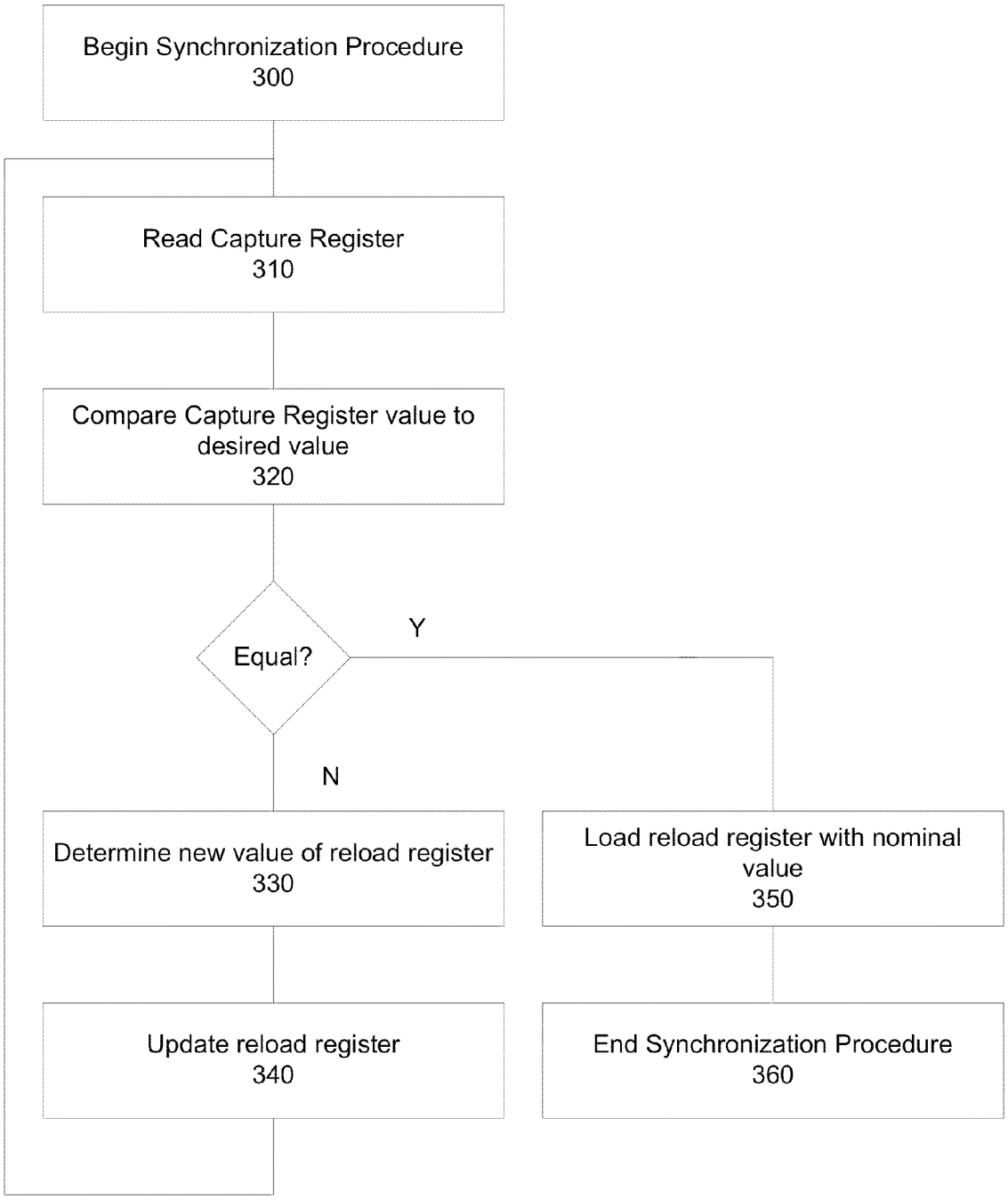
FIG. 4A is a flowchart showing the synchronization procedure according to one embodiment of the present invention.

To establish the proper temporal relationship between the timer 200 and the AC waveform, a synchronization procedure is executed, such as that shown in FIG. 4A. First, as shown in step 310, the capture register 230 is read. This value is then compared to the desired value, as defined above, in step 320. If the values differ by more than a predetermined threshold, an algorithm is employed to alter this temporal relationship. Since the AC waveform is fixed in time, this alteration involves adjusting the point at which the timer 200 is reloaded.

By way of example, assume that the desired pulse should occur 30% of a half period after a zero crossing, and the capture register 230 currently shows a value that is 80% of the maximum value, or 20,000. This implies that the pulse will occur 20% of a half period after the zero crossing. Thus, the timer 200 must be delayed relative to the AC waveform, such that the capture register 230 reads a value of 17,500.

In one embodiment, the reload register 210 is loaded with a value that equals the nominal value, plus the deviation between the desired capture value and the actual read capture value. In the example herein, the reload value would be equal to 25,000, plus 2,500, which is the difference between the actual capture register 230 value and the desired capture register value.

Conversely, if the desired capture register value is greater than the actual capture register 230 value, this implies that the pulse is occurring later than desired. In this case, this difference would be subtracted from the nominal value of the reload register 210.

Although the above description uses a first order control loop to synchronize the timer 200 and the AC waveform, it should be noted that any control algorithm, including proportional, integral, derivative, or a combination thereof, may be employed to adjust the value of the reload register 210. Using any suitable algorithm, an updated value of the reload register is determined, as shown in step 330. This updated value is then loaded into the reload register, as shown in step 340.

In the embodiment of FIG. 4A, this synchronization procedure continues until the capture register value matches the desired value. At this point, the nominal value of the reload register is loaded into the reload register, as shown in step 350. The synchronization procedure then terminates. In other embodiments, the synchronization procedure terminates when the difference between the capture register and the desired value is less than a predetermined threshold. In this case, an exact match between the desired capture value and the actual capture register may not be required.

Figure 5:
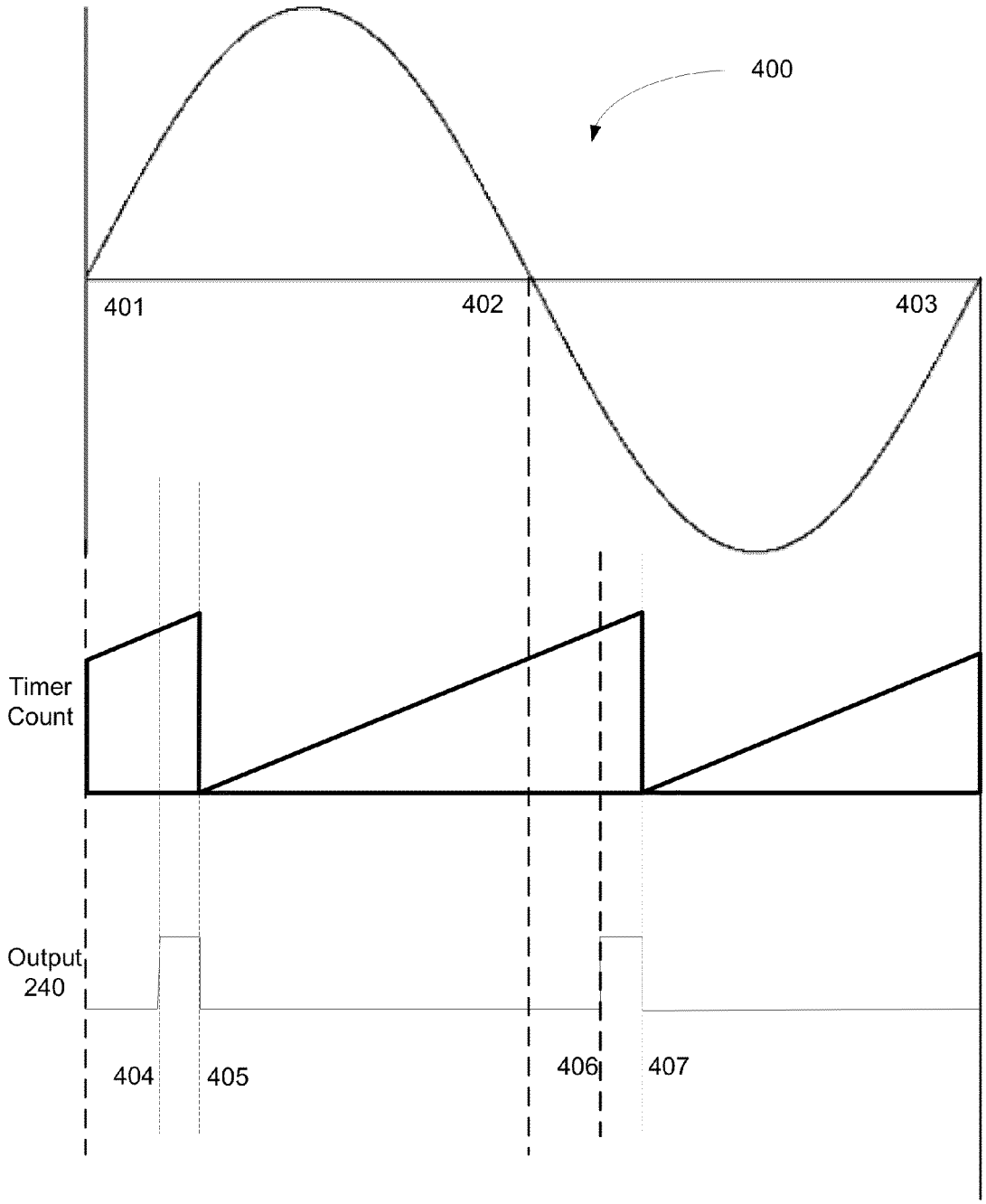
FIG. 5 is a graphical representation of the various registers used in the timer logic.

FIG. 5 is a graphical representation of the various registers used in the timer logic 200 and their respective functions. A sine wave 400, representing the AC waveform, is shown. This waveform has zero crossings at locations 401, 402 and 403. The timer count represents the value of the timer as it increases. As seen in FIG. 5, it begins a value of 0 and increments until reaching a maximum value at times 405, 407. At these points in time, the timer resets to zero and begins counting again. At times 404, 406, the timer count equals the value in the compare register 220. This causes the assertion of the output 240 at times 404, 406. The reset of the timer at times 405, 407 causes the deassertion of the output 240. The synchronization of the timer count to the sine wave 400 is done by monitoring the value of the capture register 230 at the zero crossings 401, 402, 403. By adjusting the value of the reload register 410, it is possible to achieve any predetermined temporal relationship between the timer and the sine wave 400. The period between times 404 and 405, and times 406 and 407, represents the pulse width of the output 240.

In another embodiment, the synchronization procedure continues to execute to account for any variation in the frequency of the AC waveform or drift of the timer clock frequency. In this embodiment, shown in FIG. 4B, the steps 310, 320, 330, 340 are repeated continuously, even after the compare register matches the desired value to insure that these two values continue to be equal.

Figure 4B:
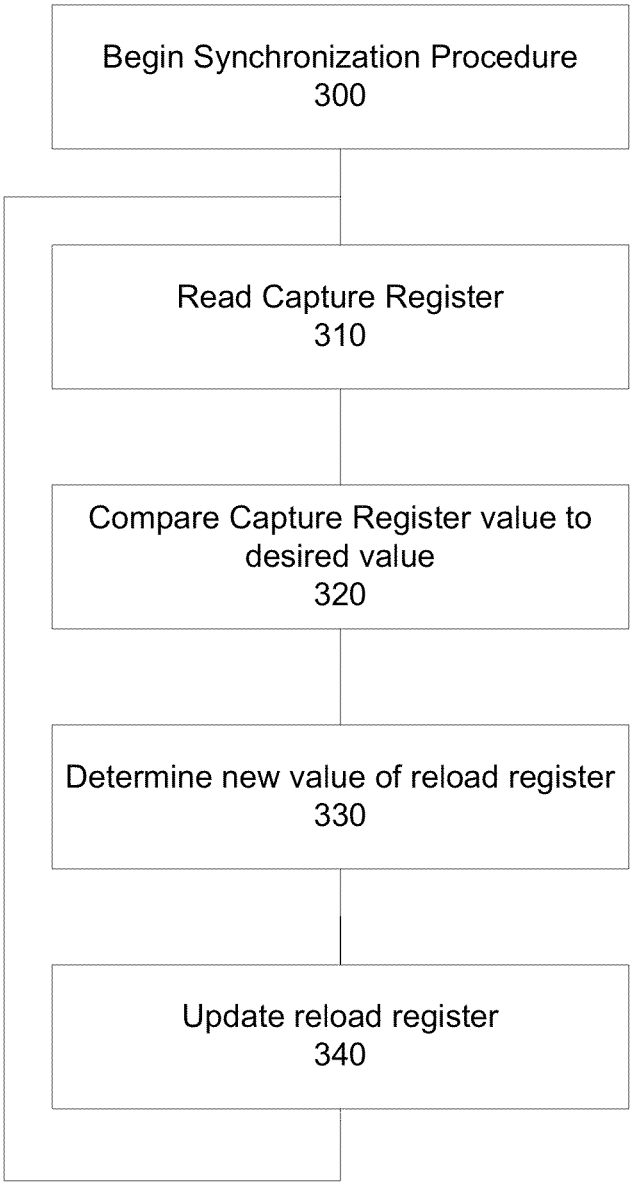
FIG. 4B is a flowchart showing the synchronization procedure according to another embodiment of the present invention.

The synchronization procedure of FIG. 4A or FIG. 4B is also used when the desired dimming level is changed by the user. In this case, the timer 200 and the AC waveform may have been synchronized to one particular dimming level, which is represented by a particular capture register value, as explained above. When the desired dimming level is changed, the desired capture register value necessarily changes. This change invokes the synchronization procedure of FIG. 4A or FIG. 4B.

It should be obvious that the above described synchronization process would also be effective if the counter was a down counter rather than an up counter. Similarly, the values and frequencies used above are illustrative only and other suitable values can also be used.

The synchronization procedure described above is performed by the processing unit 110, executing instructions stored in memory element 120. In some embodiments, the synchronization procedure is executed on a periodic basis, such as once during each half period of the AC waveform. One mechanism that can be used to allow the synchronization procedure to be periodically executed is to have its execution initiated by an interrupt, which is, in some way, associated with the AC waveform. For example, in one embodiment, a interrupt generation circuit is used, where the zero crossing of the AC waveform is used to generate an interrupt to the processing unit 110. The processing unit 110, in response to this interrupt, executes the instructions shown in FIG. 4A or FIG. 4B. Referring to FIG. 5, this interrupt may be generated at time 401, 402, 403, or some amount of time thereafter. In other embodiments, the synchronization procedure is not executed every zero crossing. In this embodiment, the interrupt generation circuit may generate an interrupt every second zero crossing, such as at times 401, 403, or some other multiple of the zero crossing.

While the interrupt generation may be directly associated with the AC waveform, such as based on its zero crossing, other embodiments are also possible. For example, the interrupt generation circuit may use timer 200 or a different timer in the system to generate interrupts to the processing unit 110.

Furthermore, while it may be desirable to have the synchronization procedure execute every half period, or every period of the AC waveform, this is not required for proper operation. Once the value of the timer 200 has been properly loaded to match the half period of the AC waveform, the system will continue operating effectively. Due to the precision of the timer 200, any drift that occurs is likely to be very small, relative to the half period of the AC waveform. Therefore, even if the reload register 210 is not adjusted for an extended period of time, flicker would not be perceived by the user.

Figure 6:
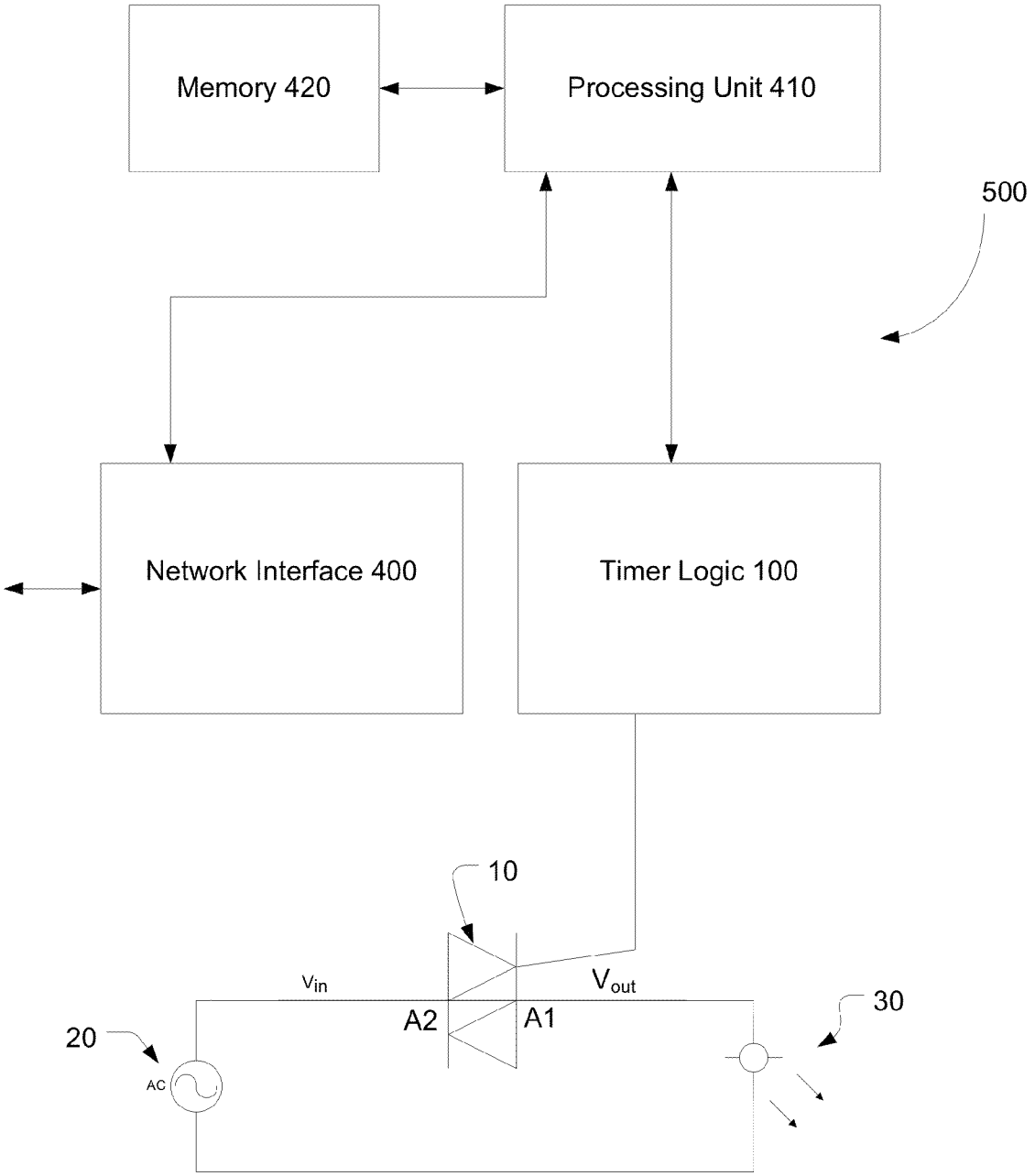
FIG. 6 is a representative schematic of a wireless network device used to control a lighting element.

While the above system and method are useful in any lighting application, they are particularly useful in a wireless remote control lighting application using a mesh network. FIG. 6 shows a block diagram of a device 500 used to wirelessly control lighting in a mesh network. This device 500 includes all of the elements of the system shown in FIG. 2, such as an AC power source 20, a triac 10, a lighting element 30, and a timer logic 100. The device also includes a processing unit 400, which is in electrical communication with a memory element 410. As in FIG. 2, the processing unit 410 executes instructions stored in memory element 420 to perform the functions required of the device 500. The device 500 also contains a network interface block 400, which communicates wirelessly with other devices, gateways and routers. The network interface block 400 contains the necessary physical components, such as antennas, analog baseband components, and MAC controllers. In one embodiment, the processing unit 410 is responsible for handling all network communications and also for controlling the lighting element 30. In this embodiment, the processing unit 410 is required to service various interrupts and other events in real time, or nearly real time. As a result, the system described in FIGS. 3 and 4 is instrumental in reducing the processing requirements and the real time nature of maintaining the lighting elements.

In fact, in some embodiments, the processing unit 410 only interacts with the lighting element 30 when the dimmer level is being changed from a previous value to a new value. This allows the processing unit 410 to be more responsive to other tasks, such as network communications.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A method of controlling a current to a load, where the load is powered by an AC voltage having a frequency and a period, the method comprising:

utilizing timer logic comprising a timer, a reload register, a capture register, a compare register and an output, wherein the timer counts to a value based on a value loaded in the reload register, resets and restarts, and wherein the output is asserted when the value of the timer is greater than a value loaded in the compare register;

electrically connecting the output to the gate of a triac, where the triac is disposed between a source of the AC voltage and the load;

loading the reload register with a value such that the timer restarts at a rate equal to twice the frequency of the AC voltage;

loading the compare register with a value less than the value of the reload register, where the difference between the value of the reload register and the value of the compare register defines a pulse width of the output;

calculating a desired temporal relationship between the restarting of the timer and the AC voltage to achieve the desired current, where said relationship can be determined by reading the value of the timer when the AC voltage is at zero voltage by reading the capture register;

reading the capture register to determine the actual temporal relationship;

determining a difference between the actual temporal relationship and the desired temporal relationship;

adjusting the value of the reload register based on the difference; and repeating the reading, determining and adjusting steps.

2. The method of claim 1, wherein the reading, determining and adjusting steps are repeated until the difference is less than a predetermined threshold.

3. The method of claim 1, wherein the reading, determining and adjusting steps are performed continuously.

4. The method of claim 1, wherein the AC load comprises a lighting element.

5. A system for controlling a current to a load, where the load is powered by an AC voltage having a frequency and a period, the system comprising:

an AC power source;

a load;

timer logic, comprising a timer;

a reload register;

a capture register;

a compare register; and an output;

wherein the timer counts to a value based on a value loaded in the reload register, resets and restarts, and wherein the output is asserted when the value of the timer is greater than a value loaded in the compare register;

a triac, disposed between the AC power source and the load, the triac having a gate electrically connected to the output;

a processing unit;

a memory element, comprising instructions executed by the processing unit;

wherein the processing unit is configured to load the reload register with a value such that the timer restarts at a rate equal to twice the frequency of the AC voltage;

load the compare register with a value less than the value of the reload register, where the difference between the value of the reload register and the value of the compare register defines a pulse width of the output;

calculate a desired temporal relationship between the restarting of the timer and the AC voltage to achieve the desired current, where said relationship can be determined by reading the value of the timer when the AC voltage is at zero voltage by reading the capture register;

read the capture register to determine the actual temporal relationship;

determine a difference between the actual temporal relationship and the desired temporal relationship;

adjust the value of the reload register based on the difference; and repeat the read, determine, and adjust functions.

6. The system of claim 5, wherein the processing unit performs the read, determine, and adjust functions until the difference is less than a predetermined threshold.

7. The system of claim 5, wherein the processing unit performs the read, determine, and adjust functions continuously.

8. The system of claim 5, further comprising an interrupt generation circuit configured to generate an interrupt, wherein the processing unit executes the read, determine, and adjust functions in response to the interrupt.

9. The system of claim 8, wherein the interrupt generation circuit generates the interrupt based on the waveform of the AC voltage.

10. The system of claim 5, wherein the load comprises a lighting device.

11. The system of claim 5, further comprising a wireless network interface, in electrical communication with the processing unit, configured to communicate with other devices.

* * * * *